US011439229B2

(12) United States Patent
Powell et al.

(10) Patent No.: US 11,439,229 B2
(45) Date of Patent: Sep. 13, 2022

(54) ADJUSTABLE HEIGHT WORKSTATION

(71) Applicant: Bridgewater Strategies, LLC, Atlanta, GA (US)

(72) Inventors: Harrison Powell, Atlanta, GA (US); Noah McNeely, Lawrenceville, GA (US)

(73) Assignee: Bridgewater Strategies, LLC, Atlanta, GA (US)

( * ) Notice: Subject to any disclaimer, the term of this patent is extended or adjusted under 35 U.S.C. 154(b) by 0 days.

(21) Appl. No.: 17/338,673

(22) Filed: Jun. 4, 2021

(65) Prior Publication Data

US 2022/0079331 A1 Mar. 17, 2022

Related U.S. Application Data

(60) Provisional application No. 63/078,973, filed on Sep. 16, 2020.

(51) Int. Cl.

| | |
|---|---|
| ***A47B 9/02*** | (2006.01) |
| ***A47B 21/02*** | (2006.01) |
| ***A47B 9/12*** | (2006.01) |

(52) U.S. Cl.

CPC ..... *A47B 9/02* (2013.01); *A47B 9/12* (2013.01); *A47B 21/02* (2013.01)

(58) Field of Classification Search

CPC ..... A47B 9/02; A47B 9/12; A47B 21/02
USPC ..... 108/136, 147
See application file for complete search history.

(56) References Cited

U.S. PATENT DOCUMENTS

| | | | | | |
|---|---|---|---|---|---|
| 3,123,829 | A * | 3/1964 | Bronson | A47B 81/04 | 211/59.3 |
| 3,411,464 | A * | 11/1968 | Mackay | A47B 9/12 | 108/136 |
| 4,751,884 | A * | 6/1988 | Ball | A47B 17/03 | 248/420 |
| 5,311,827 | A * | 5/1994 | Greene | F16M 11/18 | 74/89.22 |
| 5,715,759 | A * | 2/1998 | Lee | A47B 51/00 | 108/147 |
| 7,077,068 | B1 | 7/2006 | Agee | | |
| 7,178,469 | B2 | 2/2007 | Goza | | |
| 8,096,007 | B2 * | 1/2012 | Dyreby | A47B 9/12 | 108/147 |
| 8,342,465 | B2 * | 1/2013 | Koder | A47B 9/04 | 248/404 |
| 8,567,735 | B2 | 10/2013 | Burgess et al. | | |

(Continued)

*Primary Examiner* — Jose V Chen
(74) *Attorney, Agent, or Firm* — H. Brock Kolls

(57) ABSTRACT

This present invention relates to an adjustable height workstation comprising a mast having lock pin receptacles disposed along the mast, a work surface, and an accessory surface that is interconnected with a work surface and configured to slide along the mast. A lock pin can be inserted into a lock pin receptacle to abate the accessory surface moving along the mast. The work surface comprises a release rail that a user can operate to adjust the height of the accessory and work surfaces. A tapered pully assembly and counterbalance assembly are operationally related allowing the user to work ergonomically by adjusting the height of the accessory and the work surfaces, in a counterbalanced manner, up and down the mast in a variety of positions including floor level so that the user can work on the work surface at floor level.

20 Claims, 15 Drawing Sheets

(56) References Cited

U.S. PATENT DOCUMENTS 8,947,215 B2 2/2015 Mandel et al.
9,332,836 B1 5/2016 Zebarjad
9,655,438 B1 * 5/2017 Shoenfeld ..... A47B 21/02
9,913,532 B1 3/2018 Jones et al.
9,980,561 B1 * 5/2018 Constantino ..... A47B 21/02
10,039,372 B2 8/2018 Ergun et al.
11,129,471 B1 * 9/2021 Oglesby ..... A47B 13/081
2005/0172869 A1 * 8/2005 Schmidt ..... A47B 9/12 108/147
2009/0072101 A1 * 3/2009 Stoelinga ..... F16H 19/0663 74/89.21
2011/0042911 A1 * 2/2011 Kozlowski, Jr. ..... F16M 11/24 280/47.35
2013/0014677 A1 * 1/2013 Jussila ..... B66F 11/04 254/102
2013/0146728 A1 * 6/2013 Ergun ..... F16M 11/2021 248/299.1
2013/0200660 A1 * 8/2013 Bahnof ..... A47B 21/00 108/50.14
2016/0015167 A1 * 1/2016 Abu-Akel ..... A47B 21/02 248/161
2016/0037907 A1 * 2/2016 Ergun ..... A47B 9/20 248/188.5
2016/0058186 A1 * 3/2016 Liu ..... A47C 7/402 700/275
2016/0120300 A1 5/2016 Ergun et al.
2017/0007017 A1 * 1/2017 Herring ..... A47B 21/02
2017/0020279 A1 * 1/2017 Ergun ..... A47B 9/10
2017/0135587 A1 * 5/2017 Desroches ..... A61B 5/14551
2018/0168334 A1 * 6/2018 Swartz ..... A47B 9/02
2019/0053617 A1 * 2/2019 Laudadio ..... F16M 11/045
2019/0159586 A1 * 5/2019 Wiener ..... A47B 21/0314
2019/0269236 A1 * 9/2019 Lindblad ..... A47B 9/08
2020/0077788 A1 * 3/2020 Albers ..... A47B 9/20
2020/0170407 A1 * 6/2020 Knapp ..... A47B 9/00

* cited by examiner

ADJUSTABLE HEIGHT WORKSTATION

CROSS-REFERENCE TO RELATED APPLICATIONS

This application contains subject matter which is related to the subject matter of the following application. The below-listed application is hereby incorporated herein by reference in its entirety:

This is a U.S. non-provisional application that claims the benefit of a U.S. provisional application, Ser. No. 63/078,973, inventor Harrison Powell, entitled "ADJUSTABLE HEIGHT MOBILE WORKSTATION", filed Sep. 16, 2020.

TECHNICAL FIELD OF THE INVENTION

This invention relates to an adjustable height workstation, and particularly to an adjustable height workstation comprising a tapered pully assembly and a counterbalance assembly that are operationally related allowing a user to adjust the height of the combined accessory surface and the work surface, in a counterbalanced manner, to work ergonomically in a variety of positions including at floor level.

BACKGROUND OF THE INVENTION

Before our invention, current adjustable height workstation offerings allowed limited ergonomic working positions. In this regard, as an example, the height of work surfaces and fixtures to hold a computer display was limited to positions suitable for a person who might choose to sit on a chair/yoga ball or stand while working. In their construction, most current workstations utilize at least two support posts. The length of the support posts is selected to accommodate the higher working surfaces and as such tend to limit the adjustability of the workstation for people who choose to sit on the floor to work. In this regard, the support posts do not allow the workstation surfaces that are holding components to be lowered to a useful height in which a person sitting on the floor can comfortably work on the workstation surfaces and easily view an attached computer monitor among other things.

A key shortcoming of current workstations is that the large surface and support posts of the workstation get in the way of a user's knees thus limiting the ability and accessibility to comfortably sit correctly on the floor and work at the workstation. Also, current workstations require additional accessories to better support the ergonomic needs of a user, such as a monitor stand and keyboard attachment, none of which are easily configurable for use by a user who chooses to work while being seated on the floor.

Another shortcoming is that current workstations have limited mobility for a user to move them around a room, as they need a power source supplied by a power cord to operate motorized devices design to raise and lower the various working surfaces. Also, such configurations limit the ability of the workstation to be positioned and fitted into a corner of a room in a manner that is desirable and useable by a person.

The present invention addresses these and other shortcomings by providing a workstation that can adjust, without the need for electricity, from standing positions to sitting positions on the floor, a desk surface that allows a variety of sitting positions without getting in the way of a user's knees, utilizes a mast system to allow a variety of ergonomic attachments, exhibits the ability to fit in the corner of a room, can be moved around a room without the need for cords, and other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of an adjustable height workstation comprising a mast having a top, a bottom, and more than one of a lock pin receptacle disposed along the mast from proximate the top to proximate the bottom.

An accessory surface is configured to slide up and down along the mast. The accessory surface comprising a lifting cable, and a retractable lock pin assembly. The retractable lock pin assembly comprising at least one lock pin that when inserted into the lock pin receptacle abates the accessory surface from moving along the mast.

A work surface interconnects with the accessory surface by way of at least one conduit connector. The work surface comprising a release rail, at least one release cable is fastened at one end to the release rail and the other end to the retractable lock pin assembly.

A tapered pully assembly is attached proximate to the top of the mast. The tapered pulley assembly comprising a counterbalance wheel, and more than one lifting wheel. In operation, each of the lifting wheels is arranged in progressively larger diameters to provide a different amount of counterbalance torque. The counterbalance wheel and each of the lifting wheel is fastened together forming a unitary assembly that rotates around a central axis.

A counterbalance assembly is affixed proximate to the mast. The counterbalance assembly comprising at least one of a spring, and a counterbalance cable. The counterbalance cable connects the spring to the counterbalance wheel. The lifting cable is selectively connected to one of the lifting wheels of sufficient diameter to match the approximate force needed to counterbalance the combined weight of the accessory surface, the work surface, and objects placed on the accessory surface and the work surface.

The height of the combination of the accessory surface and the work surface is adjustable when the user repositions the release rail changing the force on the release cable, causing the retractable lock pin assembly to release the lock pin from the lock pin receptacle allowing the accessory surface and the work surface combination to slide, in a counterbalanced manner, up and down the mast.

Additional shortcomings of the prior art are overcome and additional advantages are provided through the provision of an adjustable height workstation comprising a mast having a top, a bottom, and more than one of a lock pin receptacle disposed along the mast from proximate the top to proximate the bottom.

An accessory surface is configured to slide up and down along the mast. The accessory surface comprising a lifting cable, and a retractable lock pin assembly. The retractable lock pin assembly comprising at least one lock pin that when inserted into the lock pin receptacle abates the accessory surface from moving along the mast.

A work surface interconnects with the accessory surface by way of at least one conduit connector. The work surface comprising a release rail. At least one release cable is fastened at one end to the release rail and the other end to the retractable lock pin assembly.

A tapered pully assembly is attached proximate to the top of the mast. The tapered pulley assembly comprising a counterbalance wheel, and more than one lifting wheel, in operation each of the lifting wheels is arranged in progressively larger diameters to provide a different amount of counterbalance torque. The counterbalance wheel and each of the lifting wheels is fastened together forming a unitary assembly that rotates around a central axis.

A counterbalance assembly is affixed proximate to the mast. The counterbalance assembly comprising at least one of a spring, and a counterbalance cable. The counterbalance cable connects the spring to the counterbalance wheel, the lifting cable connects to one of the lifting wheels of sufficient diameter to match the approximate force needed to counterbalance the combined weight of the accessory surface, the work surface, and any objects placed on the accessory surface and the work surface.

The height of the combination of the accessory surface and the work surface is adjustable, allowing the work surface to descend to the floor where the user can work ergonomically on the work surface at floor level.

Additional shortcomings of the prior art are overcome and additional advantages are provided through the provision of an adjustable height workstation method comprising the step of repositioning a release rail to change force on at least one of a release cable. The adjustable height workstation comprising a work surface, a mast having a top, a bottom, and more than one of a lock pin receptacle disposed along the mast, one or more of a conduit connector, an accessory surface that is configured to slide up and down along the mast, the accessory surface comprising a lifting cable, and a retractable lock pin assembly comprising at least one lock pin. The conduit connector interconnects the work surface with the accessory surface. The work surface comprising the release rail. The release cable is fastened at one end to the release rail and the opposite end to the retractable lock pin assembly.

A tapered pully assembly is attached proximate to the top of the mast. The tapered pulley assembly comprising a counterbalance wheel, and more than one lifting wheel. In operation, each of the lifting wheels is arranged in progressively larger diameters to provide a different amount of counterbalance torque. The counterbalance wheel and each of the lifting wheels is fastened together forming a unitary assembly that rotates around a central axis.

A counterbalance assembly is affixed proximate to the mast. The counterbalance assembly comprising at least one of a spring, and a counterbalance cable. The counterbalance cable connects the spring to the counterbalance wheel. The lifting cable is selectively connected to one of the lifting wheels of sufficient diameter to match the approximate force needed to counterbalance the combined weight of the accessory surface, the work surface, and any objects placed on the accessory surface and the work surface.

The method continuing with the step of causing, by way of the release cable the retractable lock pin assembly to release the lock pin from the lock pin receptacle. And the step of allowing, by way of a user, the combination of the accessory surface and the work surface to slide up and down the mast.

The method continuing with the step of releasing the release rail, by way of the user, changing force on the release cable, causing the retractable lock pin assembly to insert the lock pin into the lock pin receptacle abating the accessory surface from moving along the mast. The height of the accessory surface and the work surface combination are adjustable by the user in a counterbalanced manner. In an exemplary embodiment, a mast 114 can have a top, a bottom, and more than one of a lock pin receptacle 150 disposed along the mast 114, in one or more columns, equally spaced apart from proximate the top to proximate the bottom of the mast 114.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The foregoing and other objects, features, and advantages of the invention are apparent from the following detailed description taken in conjunction with the accompanying drawings in which.

The detailed description explains the preferred embodiments of the invention, together with advantages and features, by way of example with reference to the drawings.

DETAILED DESCRIPTION OF THE INVENTION

Figure 1:
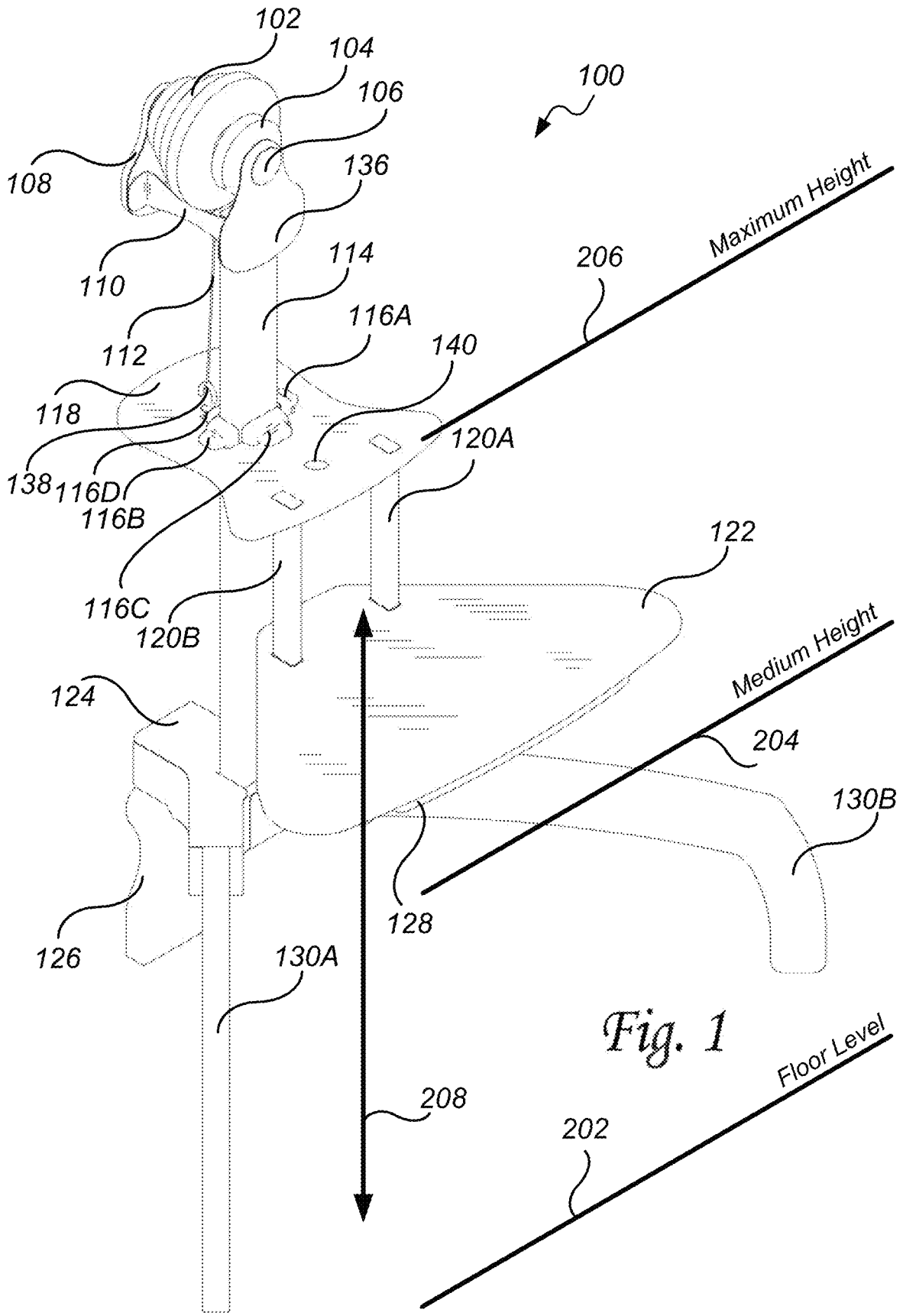
FIGS. 1-4 illustrate examples of perspective views of an adjustable height workstation.
Figure 2:
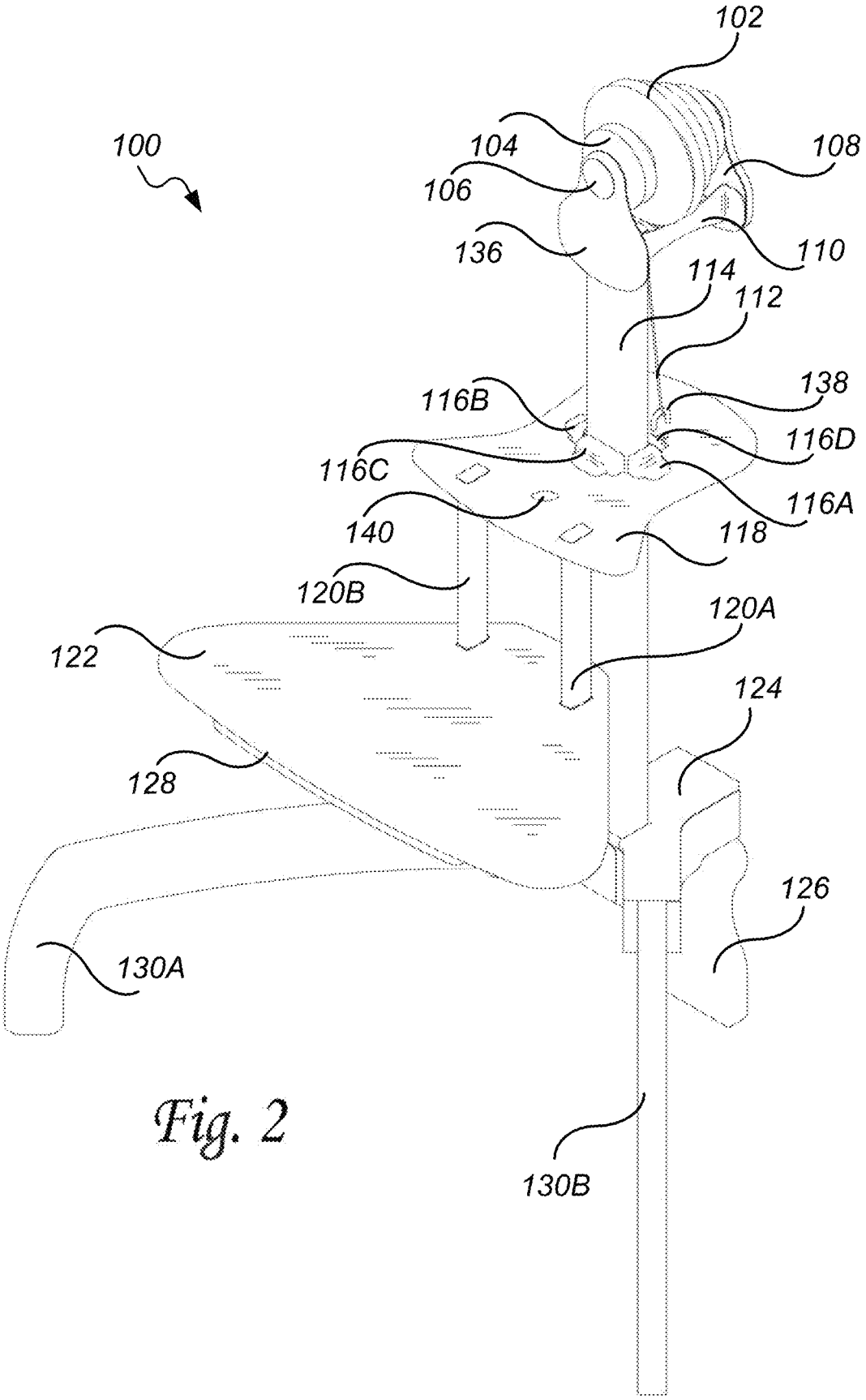

Turning now to the drawings in greater detail, it will be seen that in FIGS. 1-4 there are illustrated perspective views of an adjustable height workstation 100. FIG. 1 is a left-side perspective view of the adjustable height workstation. Referring to FIG. 2 there is illustrated a right-side perspective view of the adjustable height workstation.

Referring to FIGS. 1 and 2, in an exemplary embodiment, the adjustable-height workstation is configured to enable user 302 to adjust the height of the accessory surface 118 and work surface 122. In this regard, user 302 can transition or otherwise reposition 210 by hand the release rail 128 and slide the combination of the accessory surface 118 and work surface 122 up and down 208 along the mast 114.

An advantage in the present invention is that the work surface 122 can be repositioned the work surface 122 up and down 208 as low as the floor level 202 proximate the floor so the user 302 can ergonomically work when sitting on the floor to as high as a maximum height 206 and any point in between such as, for example, and not a limitation a medium height 204.

Another advantage of the present invention is that it does not require electricity or other power sources to adjust the height of the accessory surface 118 and work surface 122. Instead, a mechanically counterbalanced system makes it easy for the user 302 to hand operate a release rails 128 and reposition the adjustable height workstation accessory surface 118 and work surface 122 from as low as floor level 202 to as high as maximum height 206 and all point in between.

Another advantage of the present invention, in an exemplary embodiment, is that the adjustable height workstation 100 can comprise a base assembly 124. The base assembly 124 can comprise more than one of a leg 130A-B. Each of the leg 130A-B having a mast 114 connection end and a floor contact end. The base assembly 124 interconnects the mast 114 and each of the leg 130A-B by way of the mast connection end so that the floor connection end is orientated to provide contact points with the floor to stabilize the adjustable height workstation 100. Each of the leg 130A-B is positioned at an angle with respect to the mast 114 to allow the work surface to descend to the floor without contacting the leg 130A-B allowing the user 302 to work ergonomically on the work surface at floor level 202.

The adjustable height workstation can be fabricated from a combination of materials including wood, metal, plastic, and other materials, as may be required and/or desired in a particular embodiment.

In an exemplary embodiment, a mast 114 can have a top, a bottom, and more than one of a lock pin receptacle 150 disposed along the mast 114 from proximate the top to proximate the bottom of the mast 114.

An accessory surface 118 can be configured to slide up and down along the mast 114. The accessory surface 118 comprises a lifting cable 160, and a retractable lock pin assembly 134. The retractable lock pin assembly 134 can comprise at least one lock pin 154 that when inserted into the lock pin receptacle 150 abates the accessory surface 118 from sliding along the mast 114.

A work surface 122 interconnects with the accessory surface 118 by way of at least one of a conduit connector 120A-B. The work surface 122 can comprise a release rail 128. At least one of a release cable 160 can be fastened at one end to the release rail 128 and the other end to the retractable lock pin assembly 134.

A tapered pully assembly 102 and 104 in combination is attached proximate to the top of the mast 114. The tapered pulley assembly 102 and 104 in combination comprise a counterbalance wheel 104, and more than one of a lifting wheel 102, better illustrated as 102A-D in FIGS. 10A and 12A. In operation, each of the lifting wheel 102 is arranged in progressively larger diameters to provide a different amount of counterbalance torque and thus providing a different about of counterbalance force to not only counterbalance the combination of the accessory surface 118 and work surface 122 but also to counterbalance the additional weight of any objects placed on the accessory surface 118 and work surface 122. The advantage to user 302 is that repositioning the combination of the accessory surface 118 and work surface 122 loaded with stuff adding extra weight is effortless and easily done by the hand of user 302. The counterbalance wheel 104 and each of the lifting wheel 102 are fastened together forming a unitary assembly that rotates around a central axis 106.

A counterbalance assembly 152 is affixed proximate to the mast 114. The counterbalance assembly 152 can comprise at least one of a spring 156, and a counterbalance cable 132, the counterbalance cable 132 connects the spring 156 to the counterbalance wheel 104. In an exemplary embodiment, more than one counterbalance spring 156 can be combined to increase the counterbalance force while maintaining a small profile counterbalance assembly 152 as to fit nicely into the space available within the adjustable height workstation 100. In an exemplary embodiment, spring 156 can be a constant force spring, bungees, or other types and kinds of springs.

In an alternative exemplary embodiment, spring 156 can be replaced by weights configured to counterbalance, by traversing the mast 114, as the combination of the accessory surface 118 and the work surface 122 is repositioned up and down.

An advantage in the present invention is that the user can selectively connect the lifting cable 160 to one of the lifting wheel 102 of sufficient diameter to match the approximate force needed to counterbalance the combined weight of the accessory surface 118, the work surface 122, and any objects placed on the accessory surface 118 and the work surface 122.

Figure 10A:
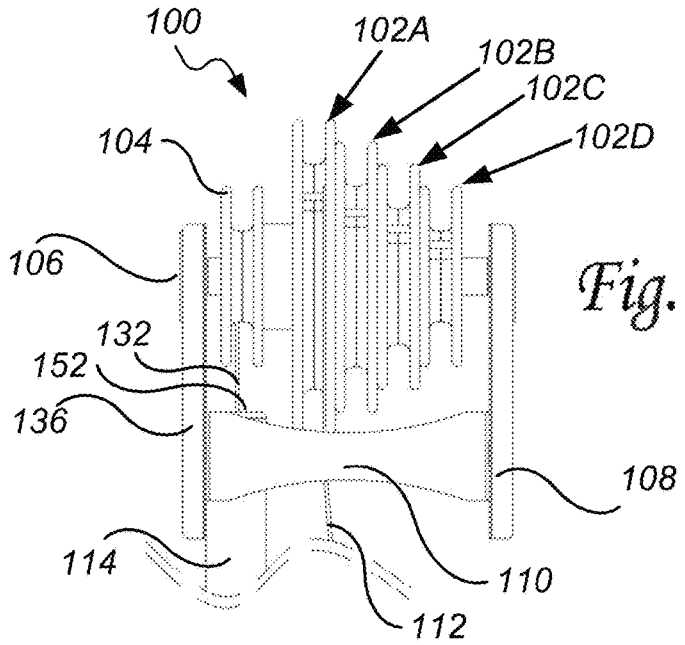
FIG. 10A illustrates one example of a right upper section elevation view enlarged to show the detail of an adjustable height workstation.
Figure 12A:
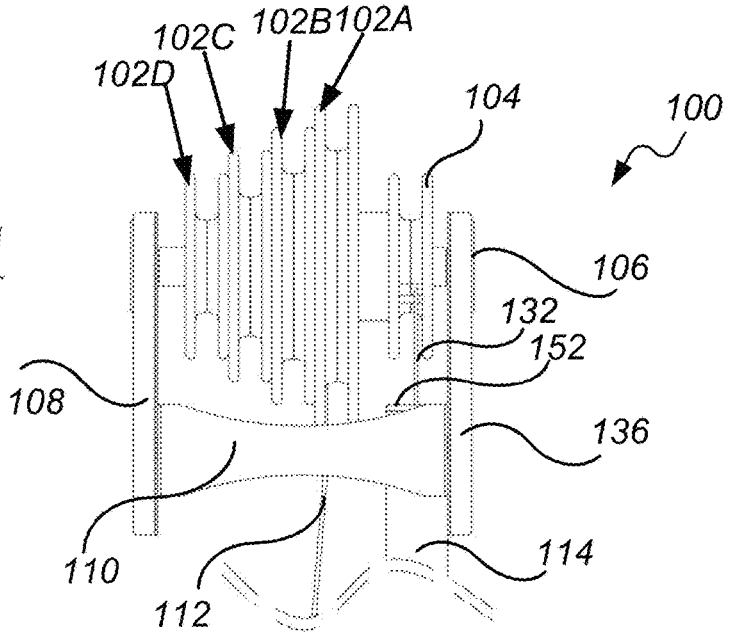
FIG. 12A illustrates one example of a left upper section elevation view enlarged to show the detail of an adjustable height workstation.

In this regard, in operation, better illustrated as 102A-D in FIGS. 10A and 12A, a user 302 selects which of the lifting wheel 102A-D to attach the lifting cable 112. The selection provides a certain amount of counterbalance torque which in turn provides a certain amount of counterbalance force to offset the weight of the combination of the accessory surface 118 and work surface 122 plus the weight of the objects on the accessory surface 118 and work surface 122. If the counterbalance force is too little the combination of the accessory surface 118 and work surface 122 will tend to want to drop to the floor during repositioning. User 302 can correct this by moving the lifting cable 112 to a different size lifting wheel 102A-D having a different size diameter to increase the counterbalance force applied to the combination of the accessory surface 118 and work surface 122.

In the alternative, if the counterbalance force is too much the combination of the accessory surface 118 and work surface 122 will tend to want to rise to the top during reposition. User 302 can correct this by moving the lifting cable 112 to a different size lifting wheel 102A-D having a different size diameter to decrease the counterbalance force applied to the combination of the accessory surface 118 and work surface 122.

Referring to FIGS. 1 and 2, the height of the combination of the accessory surface 118 and the work surface 122 is adjustable when the user 302 repositions 210 by hand the release rail 128 changing force on the release cable 160, causing the retractable lock pin assembly 134 to release the lock pin 154 from the lock pin receptacle 150 allowing the combination of the accessory surface 118 and the work surface 122 to slide, in a counterbalanced manner, up and down the mast 114.

In an exemplary embodiment, a ring connector 138 can interconnect the counterbalance cable 112 to the accessory surface 118.

In an exemplary embodiment, the accessory surface 118 can have a cable hole 140 for passing wires and cables therethrough.

In another exemplary embodiment, the conduit connector 120A-B can have a hollow core or recessed channel that traverses the length of the conduit connector 120A-B for passing cables and wires including the release cable 160.

In addition, the tapered pully assembly 102 and 104 can be rotationally supported by way of the central axis 106 in a housing assembly which comprises a front panel 136, and a back panel 108 which secures the central axis 106 therebetween and one or more side support 110 that interconnects with the front panel 136 and the rear panel 108. The housing assemble components can be affixed together and/or otherwise fastened to the top of the mast 114.

In an exemplary embodiment, a base assembly 124 can reinforcingly interconnect the legs 126 and 130A-B with the mast 114. The base assembly 124 can be designed to provide gussets and overlap which reinforces the leg structure to ensure the adjustable height workstation is sturdy and soundly constructed.

In an exemplary embodiment, two or more of a roller 116A-D can be affixed to the accessory surface 118 and configure to glide along the mast 114 edges and surface to provide smooth transitions during repositioning the combination of the accessory surface 118 and work surface 122. In this regard, the mast 114 has a left edge, a right edge, a front side, and a backside. Each of the left edge, right edge, front side, and backside traverse the length of the mast 114 from the top to the bottom. The accessory surface can further comprise the roller 116A-D. In this regard, the roller 116A-D can be fastened to the accessory surface 118. Each of the rollers can be configured to engage or otherwise contact in a rolling manner a combination of the left edge, the right edge, the front side, or the backside, providing smooth rolling transition when the combination of the accessory surface 118 and work surface 122 is repositioned by the user 302.

Figure 3:
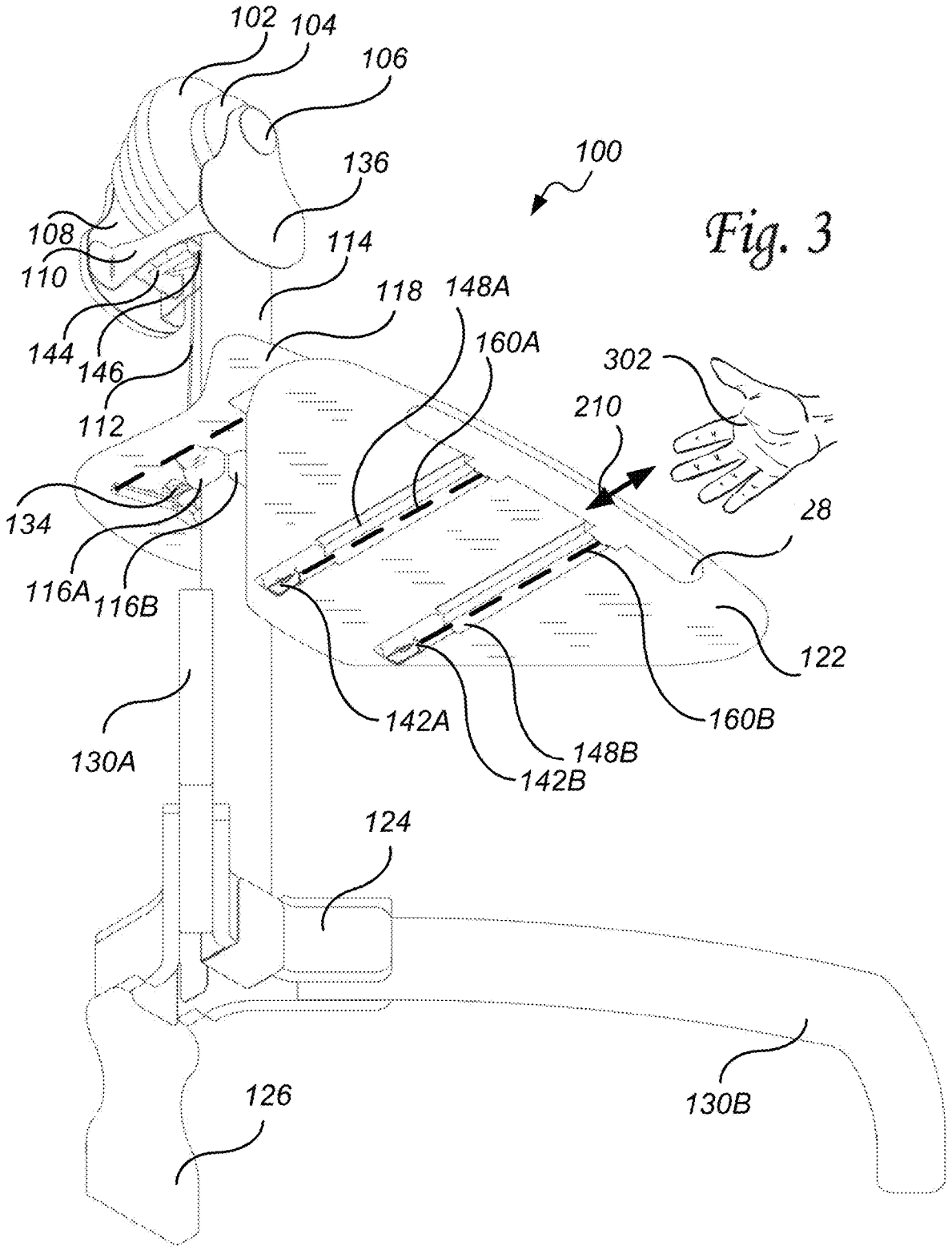
Figure 4:
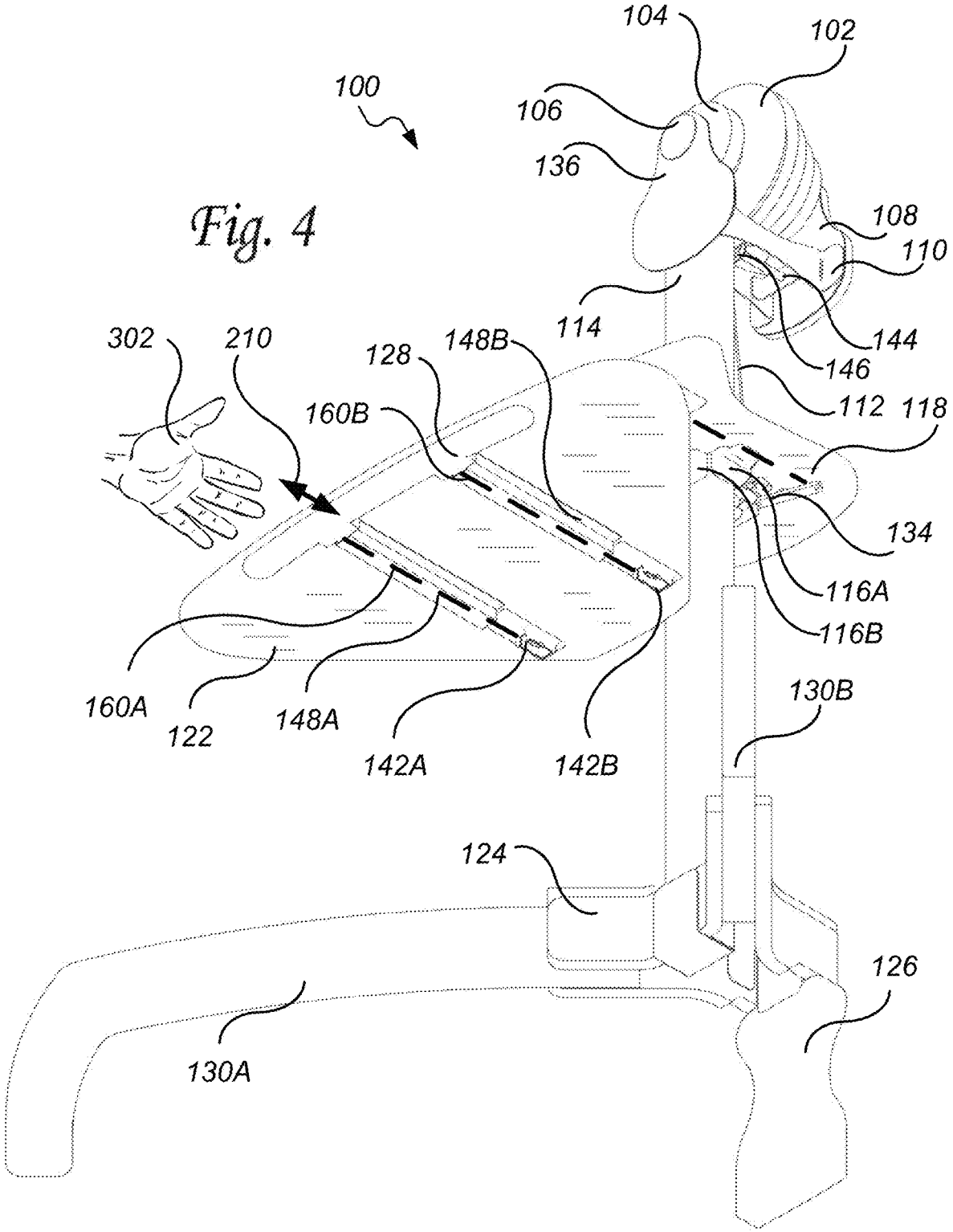

FIG. 3 illustrates a right-side perspective view of the adjustable height workstation. FIG. 4 illustrates a left-side perspective view of the adjustable height workstation. Referring to FIGS. 3 and 4, in an exemplary embodiment, one or more of the release cable 160 can be fastened at one end to the release rail 128 and traverse the underside of the work surface 122, passthrough the conduit connector 120A-B through the hollow core, traverse the underside of the accessory surface 122 and fastened at the opposite end to the retractable lock pin assembly 134. Shown as a dashed line in the Figures, the release cable 160 can be covered or otherwise mostly hidden within surface runners 148A-B and the conduit connector 120A-B. In addition, each of the surface runners 148A-B can have a roller 142A-B over which the release cable 160 can pass allowing for smooth operation around 90-degree bend when the user 302 pulls/pushes or other transitions the release rail 128 during reposition of the combination of the accessory surface 118 and work surface 122. Likewise, similarly, rollers at the accessory surface 118 connection with the conduit connector 120 can be used so that the release cable 160 can smoothly transition 90 degrees from the conduit connector 120 to follow the accessory surface 118 horizontal-plane to connect with the retractable lock pin assembly 134.

With reference to FIGS. 3 and 4 as well as FIGS. 10A and 12A, in an exemplary embodiment, a guide rod 144 can be fitted with a guide wheel 146. The guide wheel 146 is fitted over the rod and can slide along the guide rod 144, freely rotating while the guide rod 144 is secured in position between the front panel 136 and the rear panel 108. The combination of the guide rod 144 and guide wheel 146 is positioned just below the tapered pully assembly 102 and 104.

In operation, the guide wheel 146 receives the lifting cable 112 and guides the lifting cable 112 in a straight parallel manner with respect to the selected lifting wheel 102A-D. In this regard, the guide wheel 146 slides along the guide rod 144 to be positioned directly under the user 302 selected one of the lifting wheels 102A-D, and guides the lifting cable 112 onto that lifting wheel.

Figure 5:
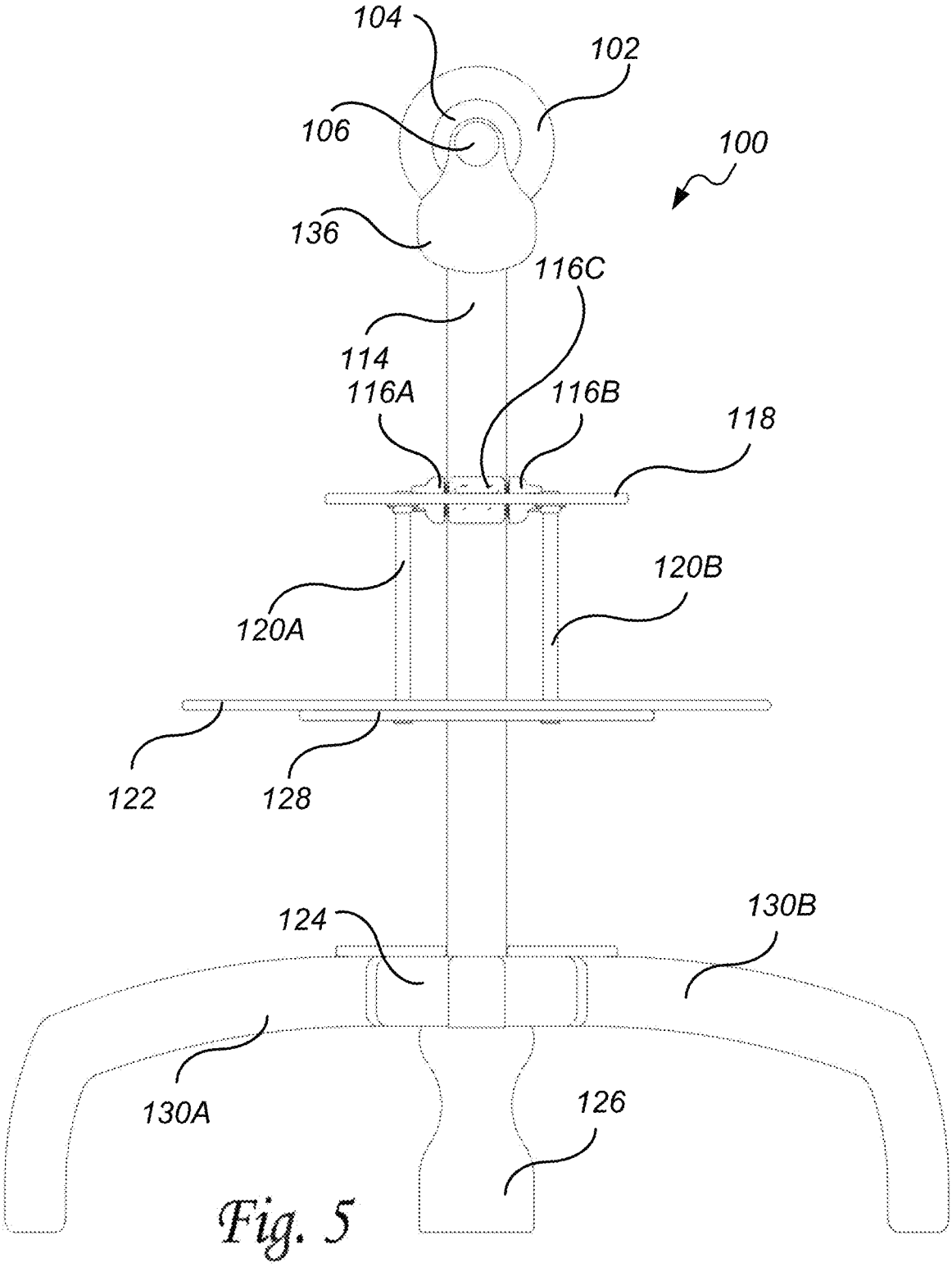
FIG. 5 illustrates one example of a front elevation view of an adjustable height workstation.
Figure 6A:
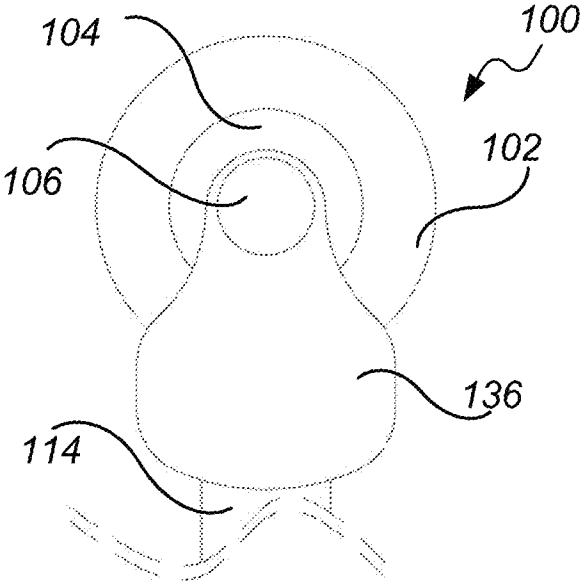
FIG. 6A illustrates one example of a front upper section elevation view enlarged to show the detail of an adjustable height workstation.
Figure 6B:
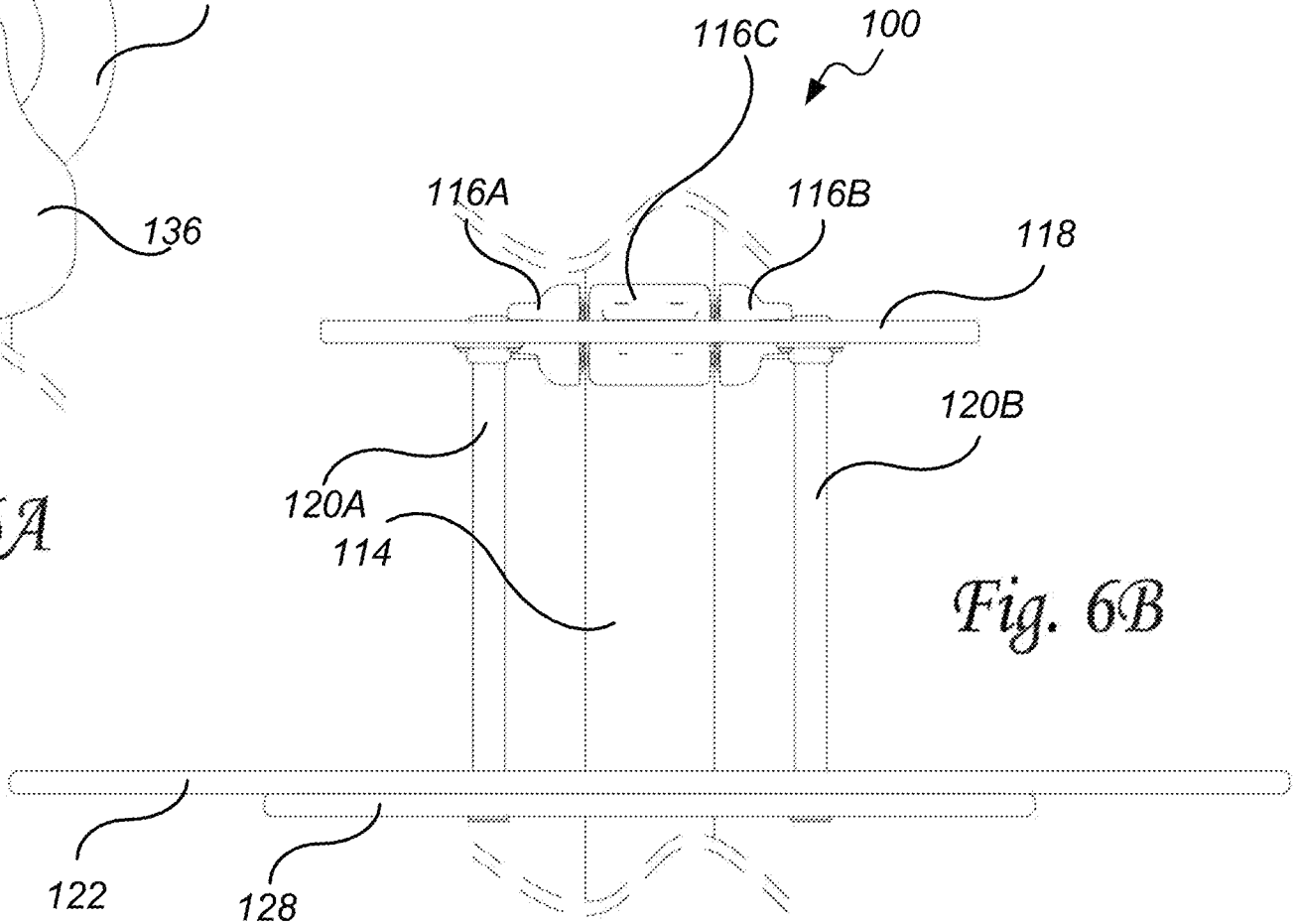
FIG. 6B illustrates one example of a front middle section elevation view enlarged to show the detail of an adjustable height workstation.

Referring to FIG. 5, there is illustrated one example of a front elevation view of the adjustable height workstation 100. Referring to FIG. 6A, there is illustrated one example of a front upper section elevation view enlarged to show the detail of the adjustable height workstation 100. Referring to FIG. 6B, there is illustrated one example of a front middle section elevation view enlarged to show the detail of the adjustable height workstation 100.

Figure 7:
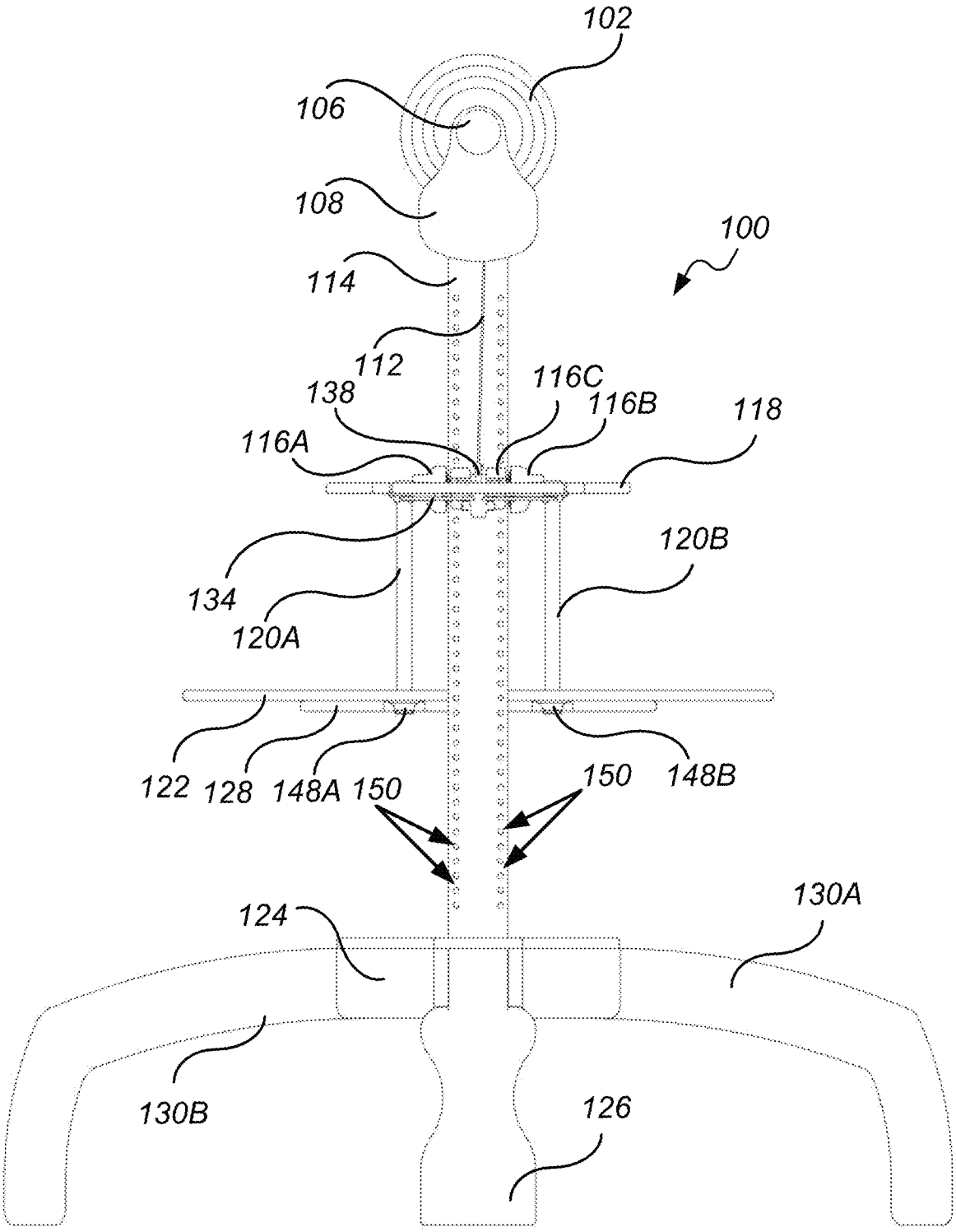
FIG. 7 illustrates one example of a back elevation view of an adjustable height workstation.
Figures 8A, 8B:
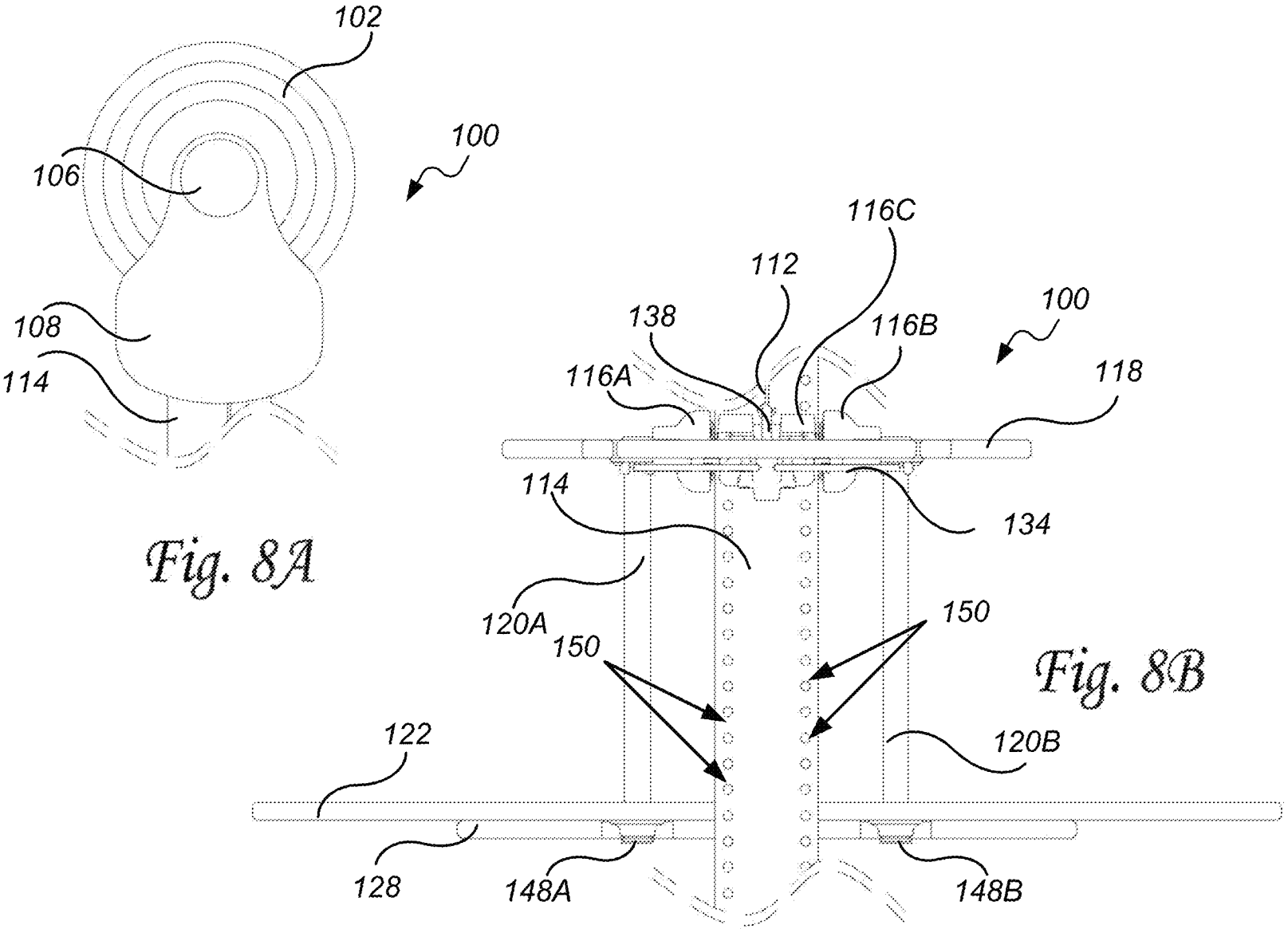
FIG. 8A illustrates one example of a back upper section elevation view enlarged to show the detail of an adjustable height workstation.
FIG. 8B illustrates one example of a back middle section elevation view enlarged to show the detail of an adjustable height workstation.
Figure 15:
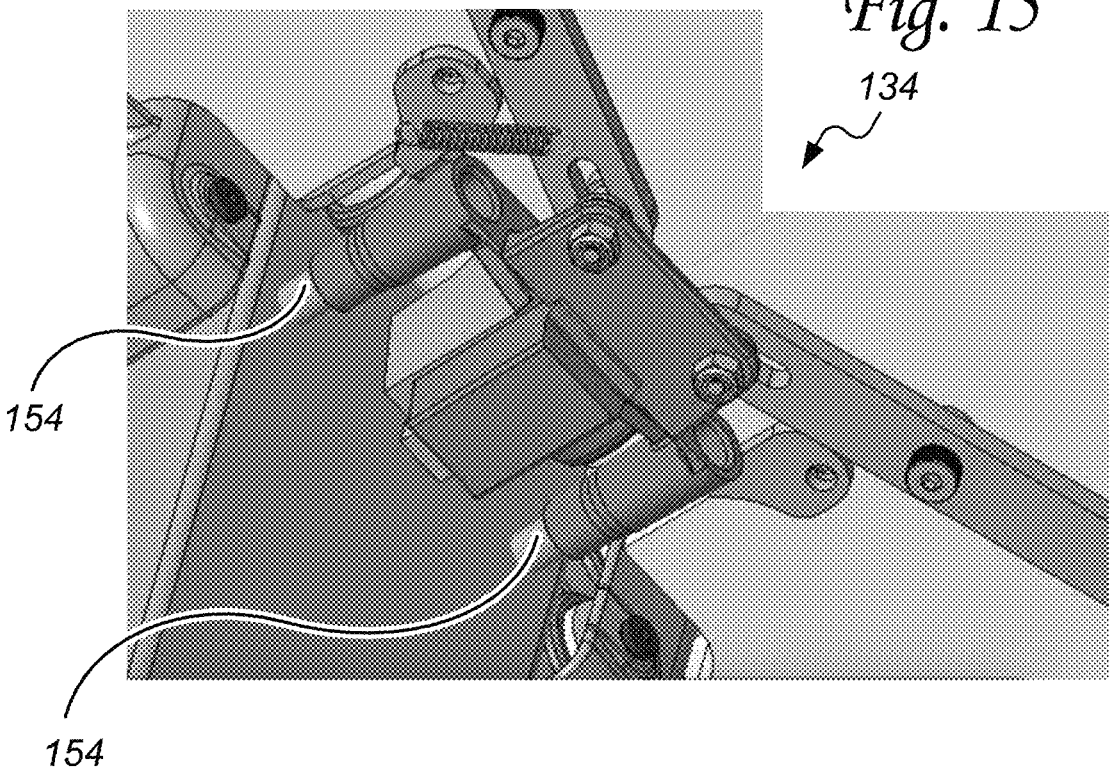
FIG. 15 illustrates one example of a retractable lock pin assembly.

Referring to FIG. 7, there is illustrates one example of a back elevation view of the adjustable height workstation 100. Referring to FIG. 8A, there is illustrated one example of a back upper section elevation view enlarged to show the detail of the adjustable height workstation 100. Referring to FIG. 8B, there is illustrated one example of a back middle section elevation view enlarged to show the detail of the adjustable height workstation 100. Referring to FIG. 15, there is illustrated one example of a retractable lock pin assembly 134.

With reference to FIGS. 7, 8A-B, and 15, in an exemplary embodiment, the mast 114 has a front side and the backside. The front side faces user 302 during the normal use of the adjustable height workstation 100. The lock pin receptacles 150 are disposed in one or more columns, equally spaced apart, along the back of the mast 114 from proximate the top of the mast 114 to proximate the bottom of the mast 114. The lock pin receptacles 150 receive one or more of a lock pin 154 which is part of the retractable lock pin assembly 134. The retractable lock pin assembly 134 is fastened to the accessory surface 118 and can be operated by way of the release cable 160.

In an exemplary embodiment, in operation, the retractable lock pin assembly 134 is operated by user 302 to transition between a locked position and an unlocked position. In a locked position one or more of the lock pin 154 is inserted into one or more of the lock pin receptacles 150 preventing the combination of the accessory surface 118 and work surface 122 from sliding along the mast 114. In an unlocked position, the lock pin 154 is disengaged from the lock pin receptacle 150 allowing user 302 to reposition the combination of the accessory surface 118 and work surface 122 along the length of the mast.

The release cable 160 is fastened at one end to the release rail 128 and traverses the work surface 122, the conduit connector 120A-B through the hollow core, and the accessory surface 118 and is fastened at the opposite end to the retractable lock pin assembly 134.

Figure 9:
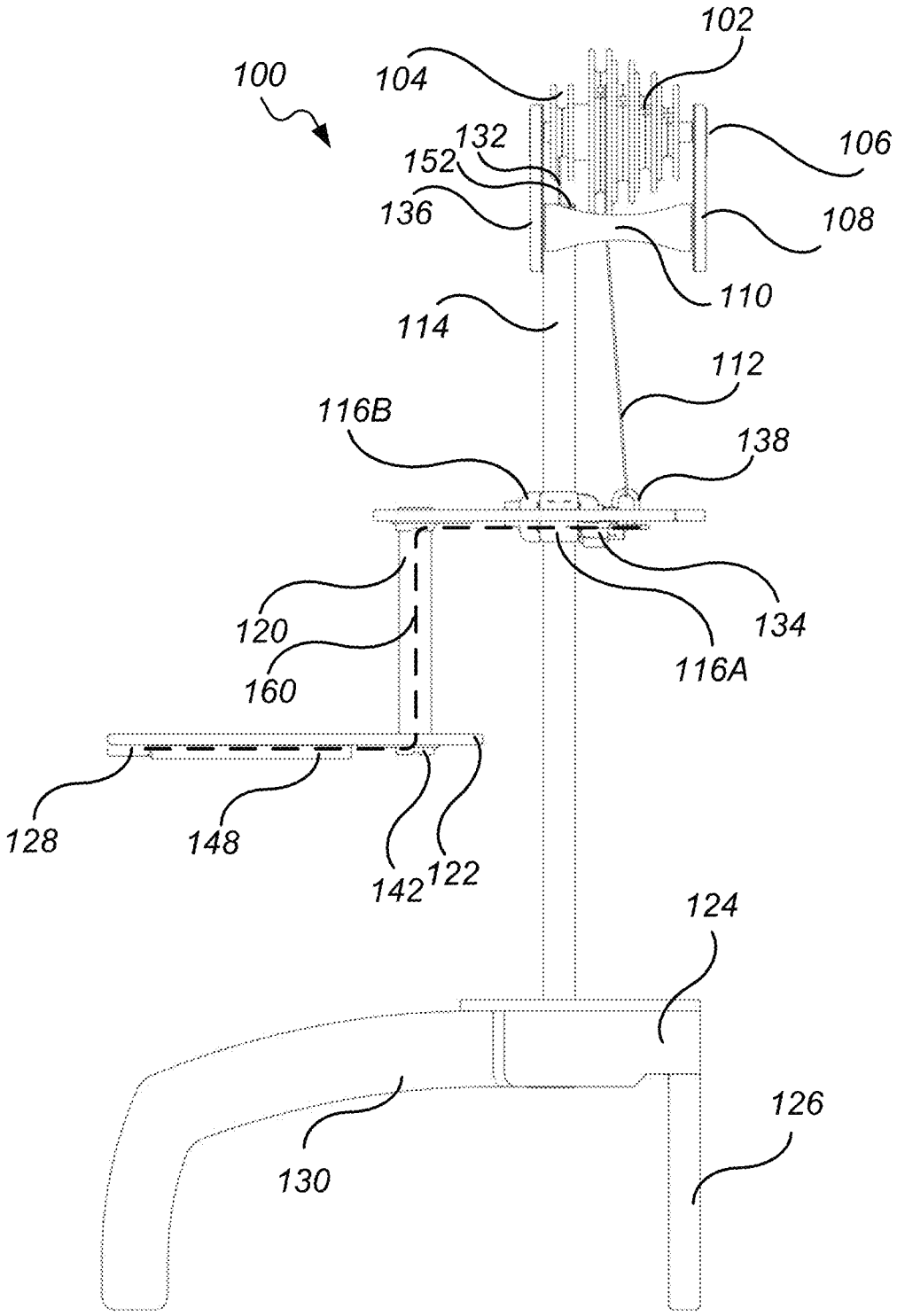
FIG. 9 illustrates one example of a right elevation view of an adjustable height workstation.
Figure 10B:
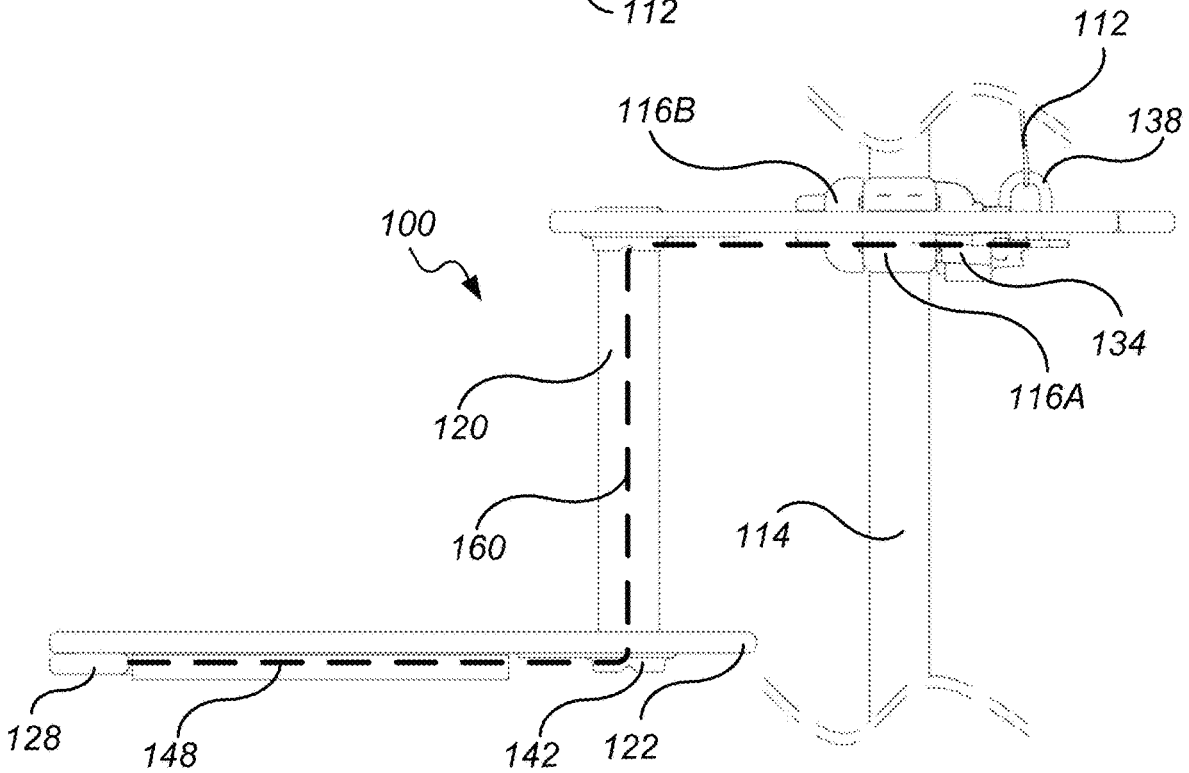
FIG. 10B illustrates one example of a right middle section elevation view enlarged to show the detail of an adjustable height workstation.
Figure 16:
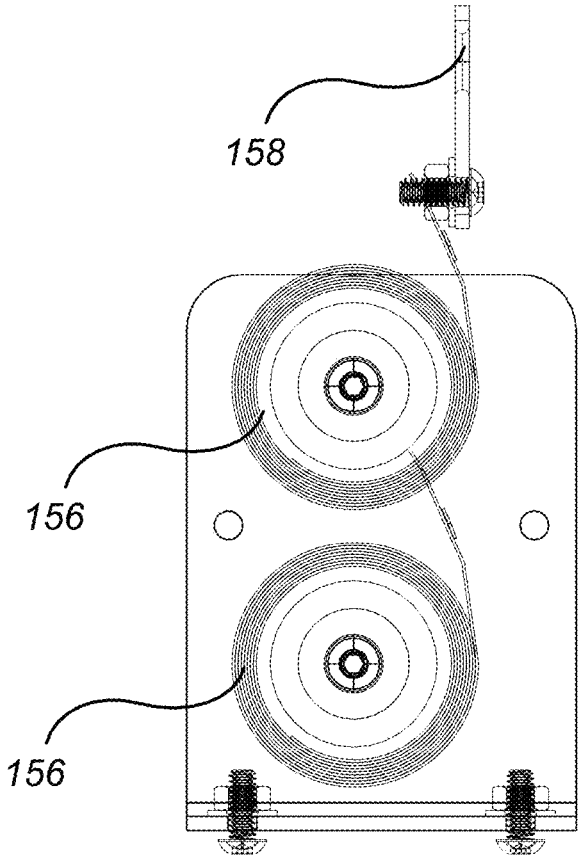
FIG. 16 illustrates one example of a counterbalance assembly.

Referring to FIG. 9, there is illustrated one example of a right elevation view of the adjustable height workstation 100. Referring to FIG. 10A, there is illustrated one example of a right upper section elevation view enlarged to show the detail of the adjustable height workstation 100. Referring to FIG. 10B, there is illustrated one example of a right middle section elevation view enlarged to show the detail of the adjustable height workstation 100. Referring to FIG. 16, there is illustrated one example of the counterbalance assembly 152.

With reference to FIGS. 9, 10A-B, and 16, in an exemplary embodiment, a counterbalance assembly 152 can be affixed proximate the mast 114, The counterbalance assembly 152 can comprise at least one of a spring 156, and a counterbalance cable 132. The counterbalance cable 132 connects the spring 156 to the counterbalance wheel 104. The lifting cable 112 is selectively connected to one of the lifting wheels 102 of sufficient diameter to match the approximate force needed to counterbalance the combined weight of the accessory surface 118, the work surface 122, and objects placed on the accessory surface 118 and the work surface 122. In an exemplary embodiment, the user 302 can selectively connect the lifting cable 112 to one of the lifting wheels 102A-D. In another exemplary embodiment, an automated device can selectively connect the lifting cable 112 to one of the lifting wheels 102A-D. In an exemplary embodiment, spring 156 can be a constant force spring, bungees, or other types and kinds of springs.

In an alternative exemplary embodiment, spring 156 can be replaced by weights configured to counterbalance, by traversing the mast 114, as the combination of the accessory surface 118 and the work surface 122 is repositioned up and down.

In operation, working together with the counterbalance assembly 152 and the combination of the tapered pully assembly 102 and 104 with the counterbalance cable 132 and the lifting cable 160, the height of the combination of the accessory surface 118 and the work surface 122 is adjustable when the user 302 repositions the release rail 128 changing force on the release cable 160, causing the retractable lock pin assembly 134 to release the lock pin 154 from the lock pin receptacle 150 allowing the combination of the accessory surface 118 and the work surface 122 to slide, in a counterbalanced manner, up and down the mast 114.

Figure 11:
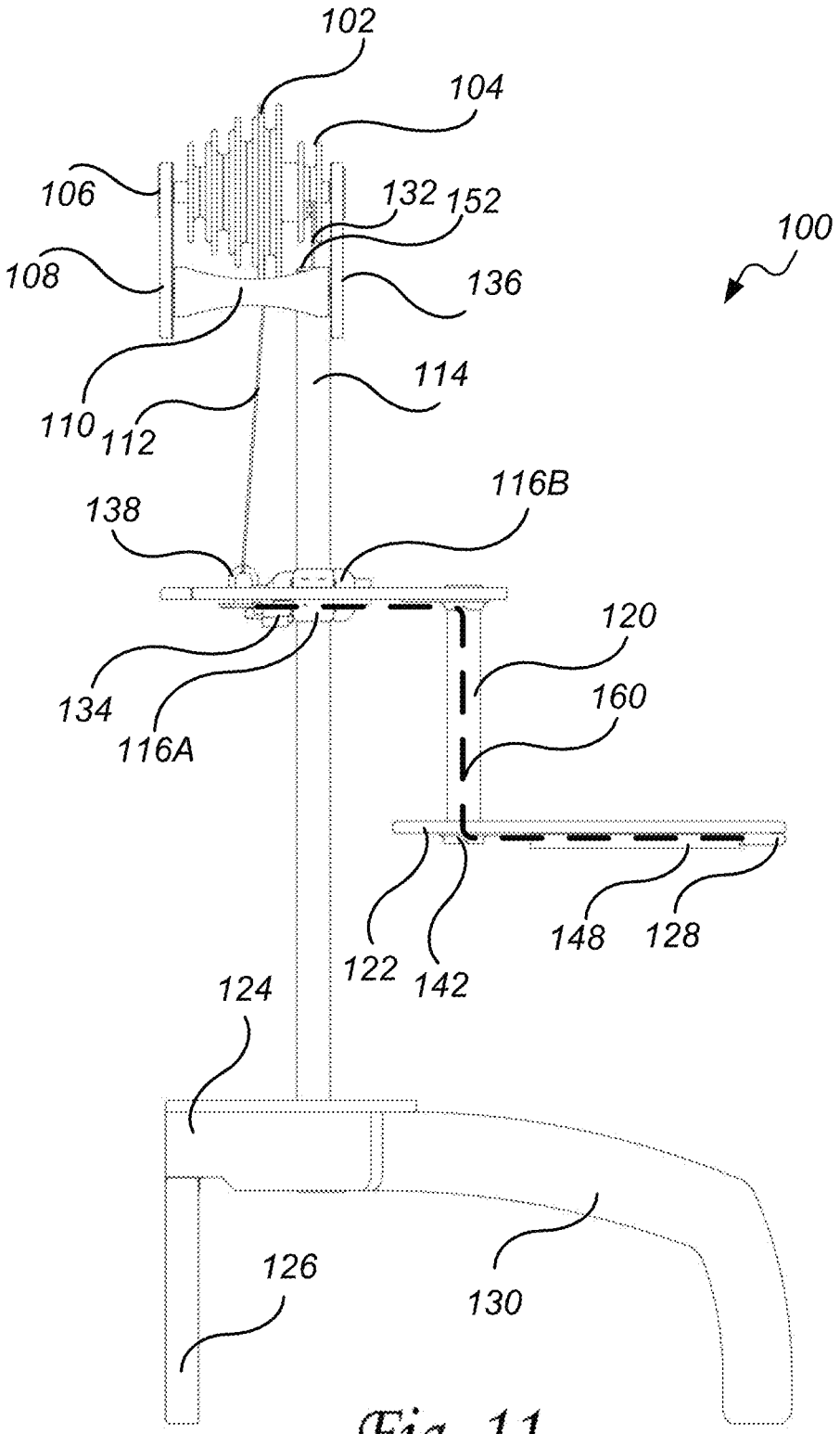
FIG. 11 illustrates one example of a left elevation view of an adjustable height workstation.
Figure 12B:
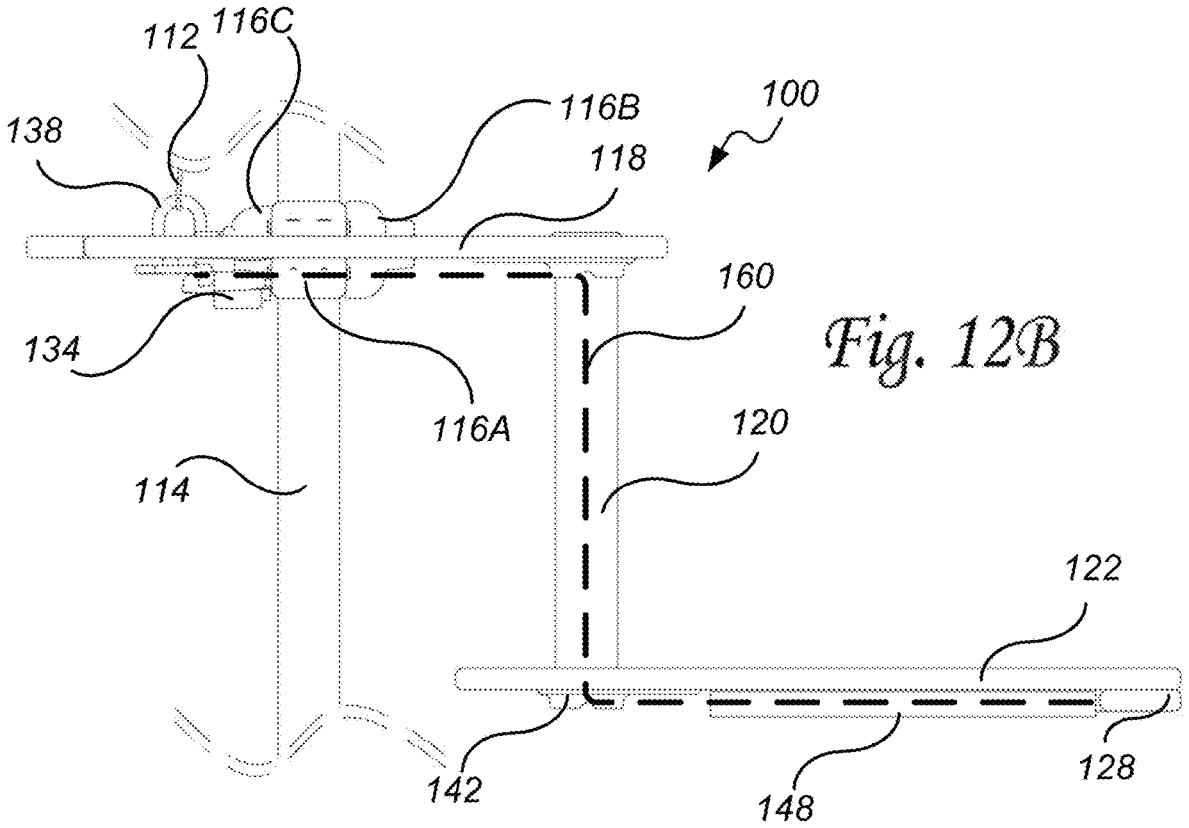
FIG. 12B illustrates one example of a right middle section elevation view enlarged to show the detail of an adjustable height workstation.
Figure 13:
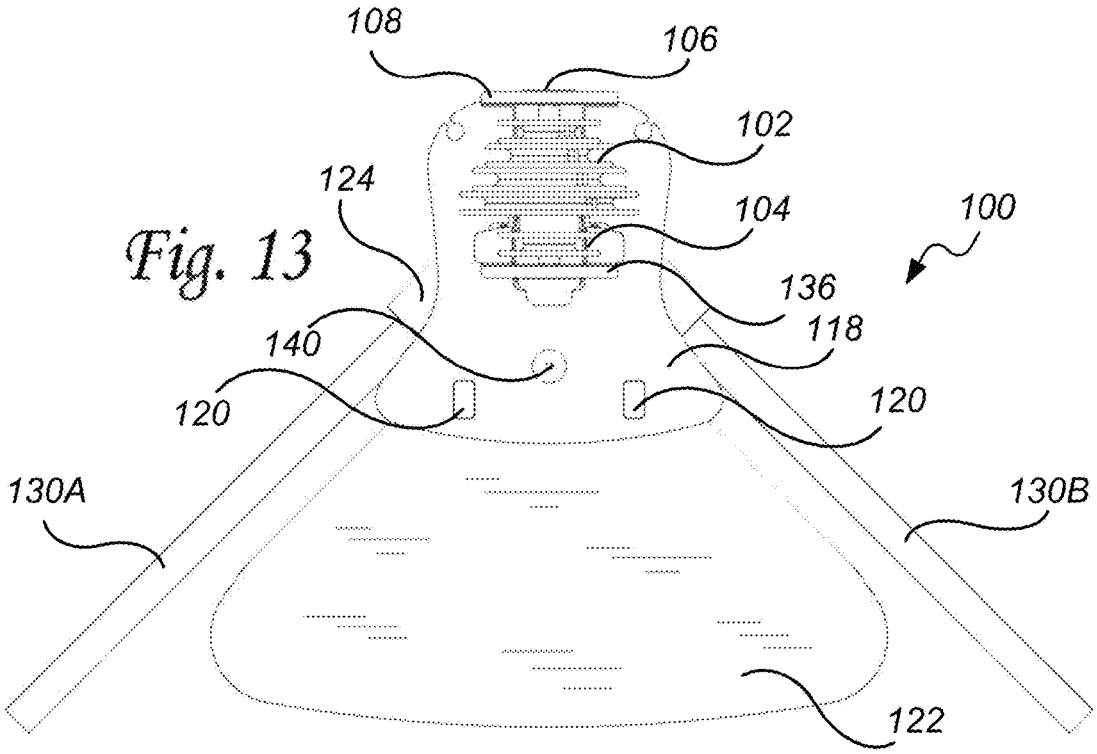
FIG. 13 illustrates one example of a top elevation view of an adjustable height workstation.
Figure 14:
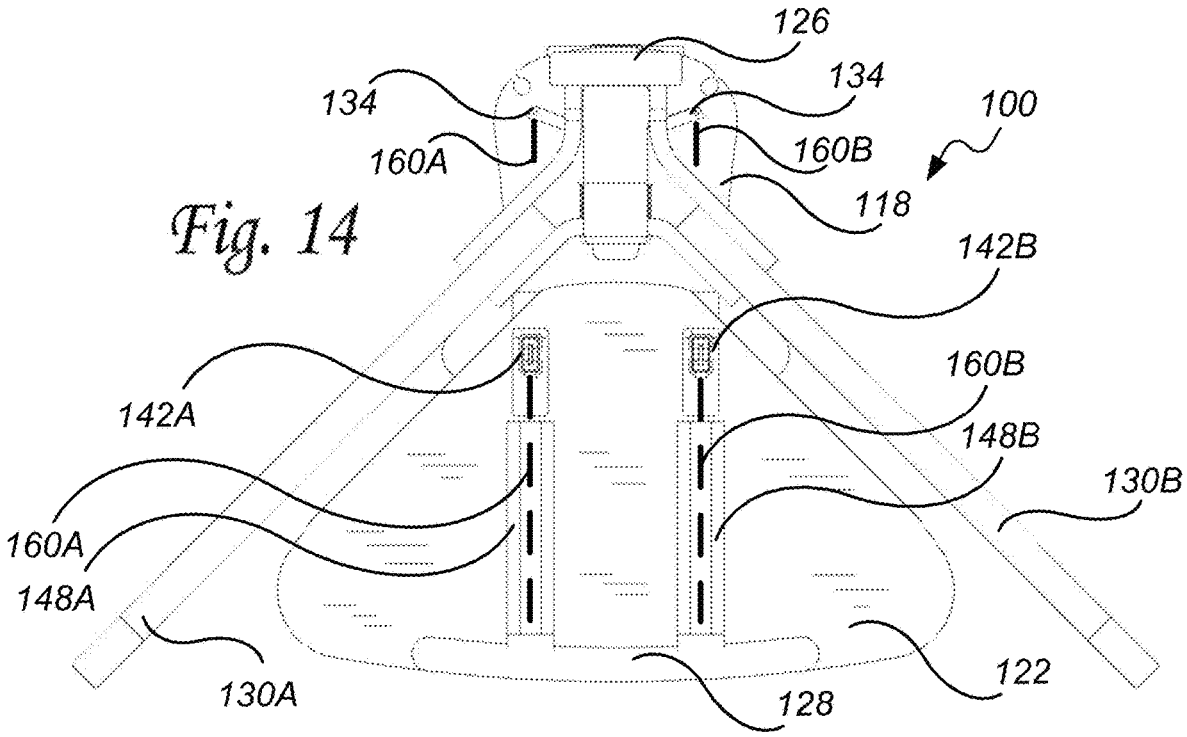
FIG. 14 illustrates one example of a bottom elevation view of an adjustable height workstation.

Referring to FIG. 11, there is illustrated one example of a left elevation view of the adjustable height workstation 100. Referring to FIG. 12A, there is illustrated one example of a left upper section elevation view enlarged to show the detail of the adjustable height workstation 100. Referring to FIG. 12B, there is illustrated one example of a right middle section elevation view enlarged to show the detail of the adjustable height workstation 100. Referring to FIG. 13, there is illustrated one example of a top elevation view of the adjustable height workstation 100. Referring to FIG. 14, there is illustrated one example of a bottom elevation view of the adjustable height workstation 100.

In an exemplary embodiment, a mast 114 can have a top, a bottom, and more than one of a lock pin receptacle 150 disposed along the mast 114 from proximate the top to proximate the bottom.

An accessory surface can be configured to slide up and down along the mast 114. The accessory surface can comprise a lifting cable 112, and a retractable lock pin assembly 134. The retractable lock pin assembly 134 can comprise at least one lock pin 154 that when inserted into the lock pin receptacle 150 abates the accessory surface 118 from sliding along the mast 114.

A work surface 122 interconnects with the accessory surface 118 by way of at least one of a conduit connector 120. The work surface 122 can comprise a release rail 128. At least one of a release cable 160 is fastened at one end to the release rail 128 and the other end to the retractable lock pin assembly 134. Shown as a dashed line in the Figures, the release cable 160 can be covered or otherwise mostly hidden within surface runners 148A-B and the conduit connector 120A-B. Rollers 142 and the top and bottom of the conduit connector 120 transition the release cable 90 degrees from horizontal with the work surface to vertical passing through the conduit connector hollow core to horizontal with the accessory surface.

The combination of a tapered pully assembly 102 and 104 is attached proximate to the top of the mast 114. The tapered pulley assembly 102 and 104 can comprise a counterbalance wheel 104, and more than one of a lifting wheel 102A-D as better illustrated in FIGS. 10A and 12A. In operation, each of the lifting wheels 102A-D is arranged in progressively larger diameters to provide a different amount of counterbalance torque. The counterbalance wheel 104 and each of the lifting wheel 102A-D are fastened together forming a unitary assembly that rotates around a central axis 106.

A counterbalance assembly 152 is affixed proximate to the mast 114. The counterbalance assembly can comprise at least one of a spring 156, and a counterbalance cable 132. The counterbalance cable 132 connects spring 156 to the counterbalance wheel 104. The lifting cable 112 connects to one of the lifting wheels 102A-D of sufficient diameter to match the approximate force needed to counterbalance the combined weight of the accessory surface 118, the work surface 122, and objects placed on the accessory surface 118 and the work surface 122. In an exemplary embodiment, more than one counterbalance spring 156 can be combined to increase the counterbalance force while maintaining a small profile counterbalance assembly 152 as to fit nicely into the space available within the adjustable height workstation 100. In an exemplary embodiment, spring 156 can be a constant force spring, bungees, or other types and kinds of springs.

In an alternative exemplary embodiment, spring 156 can be replaced by weights configured to counterbalance, by traversing the mast 114, as the combination of the accessory surface 118 and the work surface 122 is repositioned up and down.

In operation, the height of the combination of the accessory surface 118 and the work surface 122 is adjustable, allowing the work surface 122 to descend to the floor where the user 302 can work ergonomically on the work surface at floor level 202.

Figure 17:
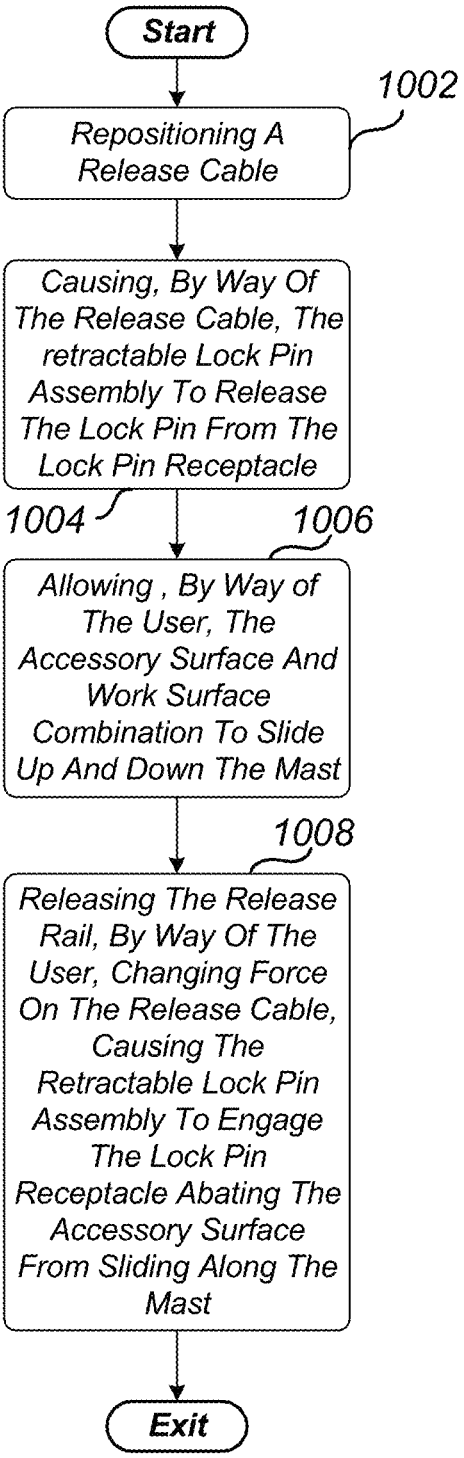
FIG. 17 illustrates one example of an adjustable height workstation method.

Referring to FIG. 17, there is illustrated one example of an adjustable height workstation method. The method begins in step 1002.

In step 1002, a release rail 128 is repositioned to change force on at least one of a release cable 160. The adjustable height workstation 100 can comprise a work surface 122, a mast 114 having a top, a bottom, and more than one of a lock pin receptacle 150 disposed along the mast 114, one or more of a conduit connector 120, an accessory surface 118 that is configured to slide up and down along the mast 114 comprising a lifting cable 112, and a retractable lock pin assembly 134 comprising at least one lock pin 154. The conduit connector 120 interconnects the work surface 122 with the accessory surface 118. The work surface 122 comprising the release rail 128, The release cable 160 is fastened at one end to the release rail 128 and the opposite end to the retractable lock pin assembly 134.

The combination of a tapered pully assembly 102 and 104 is attached proximate to the top of the mast 114. The tapered pulley assembly 102 and 104 comprising a counterbalance wheel 104, and more than one of a lifting wheel 102A-D as better illustrated in FIGS. 10A and 12A. In operation, each of the lifting wheels 102A-D is arranged in progressively larger diameters to provide a different amount of counterbalance torque. The counterbalance wheel 104 and each of the lifting wheel 102A-D are fastened together forming a unitary assembly that rotates around a central axis 106.

A counterbalance assembly 152 is affixed proximate to the mast 114. The counterbalance assembly 152 comprising at least one of a spring 156, and a counterbalance cable 132. The counterbalance cable 132 connects spring 156 to the counterbalance wheel 104. The lifting cable 112 can be selectively connected to one of the lifting wheels 102A-D of sufficient diameter to match the approximate force needed to counterbalance the combined weight of the accessory surface 118, the work surface 122, and objects placed on the accessory surface 118 and the work surface 122. In an exemplary embodiment, user 302 can selectively connect lifting cable 112 to one of the lifting wheels 102A-D. In another exemplary embodiment, an automated device can selectively connect lifting cable 112 to one of the lifting wheels 102A-D. In an exemplary embodiment, spring 156 can be a constant force spring, bungees, or other types and kinds of springs.

In an alternative exemplary embodiment, spring 156 can be replaced by weights configured to counterbalance, by traversing the mast 114, as the combination of the accessory surface 118 and the work surface 122 is repositioned up and down. The method moves to step 1004.

In step 1004, causing, by way of the release cable 160, the retractable lock pin assembly 134 to release the lock pin 154 from the lock pin receptacle 150. The method moves to step 1006.

In step 1006, allowing, by way of a user 302, the combination of the accessory surface 118 and the work surface 122 to slide up and down the mast 114. The method moves to step 1008.

In step 1008, the release rail 128 is released, by way of the user 302, changing force on the release cable 160, causing the retractable lock pin assembly 134 to insert the lock pin 154 within the lock pin receptacle 150 abating the accessory surface 118 from sliding along the mast 114. In operation, the height of the combination of the accessory surface 118 and the work surface 122 is adjustable by the user 302 in a counterbalanced manner. The method is then exited.

Figure 18:
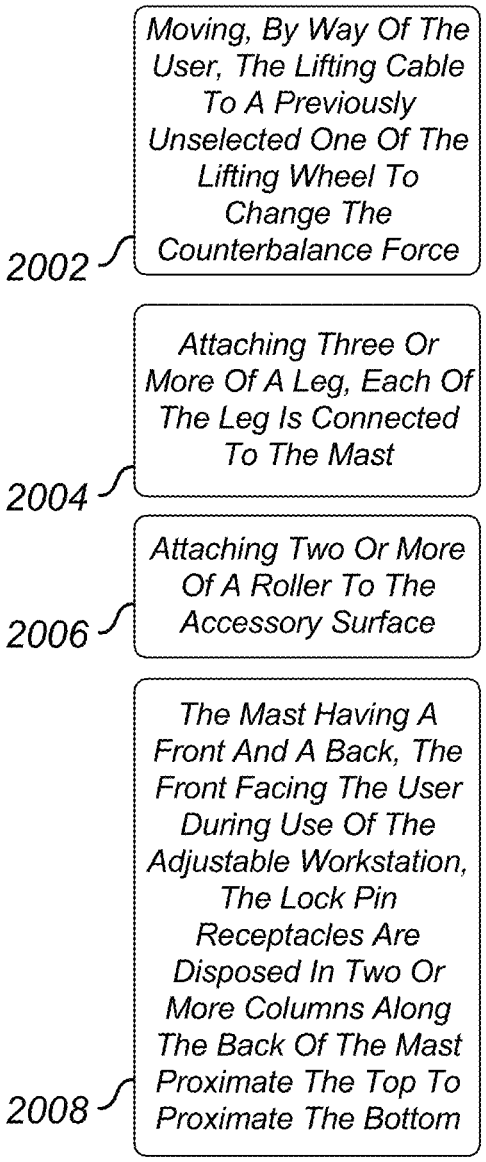
FIG. 18 illustrates exemplary embodiments of an adjustable height workstation method.

Referring to FIG. 18, exemplary embodiment of an adjustable height workstation method that can be used interchangeably with the methods of the present invention.

In step 2002, moving, by way of the user, the lifting cable 112 to a previously unselected one of the lifting wheels 102A-D to change the counterbalance force.

In step 2004, configuring a base assembly 124. The base assembly 124 can comprise more than one of a leg 130A-B. Each of the leg 130A-B having a mast 114 connection end and a floor contact end. The base assembly 124 interconnects the mast 114 and each of the leg 130A-B by way of the mast connection end so that the floor connection end is orientated to provide contact points with the floor to stabilize the adjustable height workstation 100. Each of the leg 130A-B is positioned at an angle with respect to the mast 114 to allow the work surface to descend to the floor without contacting the leg 130A-B allowing the user 302 to work ergonomically on the work surface at floor level 202.

In step 2006, attaching two or more of a roller 116A-D to the accessory surface 118. The mast having a left edge, a right edge, a front side, and a backside. Each of the left edge, right edge, front side, and backside traverse the length of the mast 114 from the top to the bottom. Each of the roller 116A-D is configured to engage or otherwise contact either the left edge, the right edge, the front side, or the backside, providing a smooth transition when the combination of the accessory surface 118 and work surface 122 is repositioned by the user 302.

In step 2008, the mast 114 having a front side and the backside. The front side facing user 302 during use of the adjustable height workstation 100. The lock pin receptacle 150 is disposed in one or more columns along the backside of the mast 114 from proximate the top to proximate the bottom of the mast 114.

While the preferred embodiment of the invention has been described, it will be understood that those skilled in the art, both now and in the future, may make various improvements and enhancements.

What is claimed is:

1. An adjustable height workstation comprising:

a mast comprising a top, a bottom, and more than one of a lock pin receptacle disposed along the mast from proximate the top to proximate the bottom;

an accessory surface is configured to slide up and down along the mast, the accessory surface comprising a retractable lock pin assembly, the retractable lock pin assembly comprising at least one lock pin that when inserted into the lock pin receptacle abates the accessory surface from moving along the mast, at least one of a conduit connector comprising a first conduit connector end, and a second conduit connector end, the accessory surface interconnects with the first conduit connector end;

a work surface interconnects with the second conduit connector end, the work surface comprising a release rail, at least one of a release cable connects the release rail to the retractable lock pin assembly;

a tapered pully assembly is attached proximate to the top of the mast, the tapered pulley assembly comprising a counterbalance wheel, and more than one of a lifting wheel, in operation each of the lifting wheel is arranged in progressively larger diameters to provide varying amounts of counterbalance torque, the counterbalance wheel and each of the lifting wheel is fastened together forming a unitary assembly that rotates around a central axis; and a counterbalance assembly is affixed to the mast, the counterbalance assembly comprising at least one of a spring, a counterbalance cable connects the spring to the counterbalance wheel, a lifting cable connects the accessory surface to the lifting wheel, wherein combination of the accessory surface and the work surface height is adjustable when a user repositions the release rail causing the retractable lock pin assembly to release the lock pin from the lock pin receptacle allowing combination of the accessory surface and the work surface to slide, in counterbalanced manner, up and down the mast.

2. The adjustable height workstation in accordance with claim 1, the conduit connector comprising a hollow core or recessed channel that traverses length of the conduit connector.

3. The adjustable height workstation in accordance with claim 2, the release cable is fastened at one end to the release rail and traverses the work surface, the conduit connector through the hollow core, and the accessory surface and is fastened at opposite end to the retractable lock pin assembly.

4. The adjustable height workstation in accordance with claim 1, further comprising:

a base assembly comprising more than one of a leg, each of the leg comprising a mast connection end and a floor contact end, the base assembly interconnects the mast and each of the leg by way of the mast connection end so that the floor connection end is orientated to provide contact points with floor to stabilize the adjustable height workstation.

5. The adjustable height workstation in accordance with claim 4, wherein each of the leg is positioned at an angle with respect to the mast to allow the work surface to descend to the floor without contacting the leg allowing the user to work ergonomically on the work surface at floor level.

6. The adjustable height workstation in accordance with claim 1, further comprising:

two or more of a roller, the mast comprising a left edge, a right edge, a front side, and a backside, each of the left edge, right edge, front side, and backside traverse the length of the mast from the top to the bottom, the accessory surface further comprising the roller, each of the roller is configured to engage either the left edge, the right edge, the front side, or the backside, providing smooth transition when combination of the accessory surface and work surface is repositioned by the user.

7. The adjustable height workstation in accordance with claim 1, wherein the mast comprising a front side and the backside, the front side facing the user during use of the adjustable height workstation, the lock pin receptacle are disposed in one or more columns along the backside of the mast from proximate the top to proximate the bottom.

8. The adjustable height workstation in accordance with claim 1, wherein the retractable lock pin assembly is operated by the user to transition between:

a locked position where the lock pin is inserted into the lock pin receptacle preventing combination of the accessory surface and work surface from sliding along the mast; and an unlocked position where the lock pin is disengaged from the lock pin receptacle allowing the user to reposition combination of the accessory surface and work surface along length of the mast.

9. An adjustable height workstation comprising:

a mast comprising a top, a bottom, and more than one of a lock pin receptacle disposed along the mast from proximate the top to proximate the bottom;

an accessory surface is configured to slide up and down along the mast, the accessory surface comprising a retractable lock pin assembly, the retractable lock pin assembly comprising at least one lock pin that when inserted into the lock pin receptacle abates the accessory surface from moving along the mast, at least one of a conduit connector comprising a first conduit connector end, and a second conduit connector end, the accessory surface interconnects with the first conduit connector end;

a work surface interconnects with the second conduit connector end, the work surface comprising a release rail, at least one of a release cable connects the release rail to the retractable lock pin assembly;

a tapered pully assembly is attached proximate to the top of the mast, the tapered pulley assembly comprising a counterbalance wheel, and more than one of a lifting wheel, in operation each of the lifting wheel is arranged in progressively larger diameters to provide varying amounts of counterbalance torque, the counterbalance wheel and each of the lifting wheel is fastened together forming a unitary assembly that rotates around a central axis; and a counterbalance assembly is affixed to the mast, the counterbalance assembly comprising at least one of a spring, a counterbalance cable connects the spring to the counterbalance wheel, a lifting cable connects the accessory surface to the lifting wheel, wherein combination of the accessory surface and the work surface height is adjustable, allowing the work surface to descend to the floor where a user can work ergonomically on the work surface at floor level.

10. The adjustable height workstation in accordance with claim 9, the conduit connector comprising a hollow core or recessed channel that traverses length of the conduit connector.

11. The adjustable height workstation in accordance with claim 10, the release cable is fastened at one end to the release rail and traverses the work surface, the conduit connector through the hollow core, and the accessory surface and is fastened at opposite end to the retractable lock pin assembly.

12. The adjustable height workstation in accordance with claim 9, further comprising:

a base assembly comprising more than one of a leg, each of the leg comprising a mast connection end and a floor contact end, the base assembly interconnects the mast and each of the leg by way of the mast connection end so that the floor connection end is orientated to provide contact points with floor to stabilize the adjustable height workstation.

13. The adjustable height workstation in accordance with claim 12, wherein each of the leg is positioned at an angle with respect to the mast to allow the work surface to descend to the floor without contacting the leg allowing the user to work on the work surface at floor level.

14. The adjustable height workstation in accordance with claim 9, further comprising:

two or more of a roller, the mast comprising a left edge, a right edge, a front side, and a backside, each of the left edge, right edge, front side, and backside traverse the length of the mast from the top to the bottom, the accessory surface further comprising the roller, each of the roller is configured to engage either the left edge, the right edge, the front side, or the backside, providing smooth transition when combination of the accessory surface and work surface are repositioned by the user.

15. The adjustable height workstation in accordance with claim 9, wherein the mast comprising a front side and the backside, the front side facing the user during use of the adjustable height workstation, the lock pin receptacle are disposed in one or more columns along the backside of the mast from proximate the top to proximate the bottom.

16. An adjustable height workstation method comprising the steps of:

repositioning a release rail to change height of a work surface, the adjustable height workstation comprising the work surface, a mast comprising a top, a bottom, and more than one of a lock pin receptacle disposed along the mast, one or more of a conduit connector comprising a first conduit connector end, and a second conduit connector end, and an accessory surface that is configured to slide up and down along the mast, the accessory surface comprising a retractable lock pin assembly, the retractable lock pin assembly comprising at least one of a lock pin, the work surface interconnects with the second conduit connector end and the accessory surface interconnects with the first conduit connector end, the work surface comprising the release rail, a release cable connects the release rail to the retractable lock pin assembly, a tapered pully assembly is attached proximate to the top of the mast, the tapered pulley assembly comprising a counterbalance wheel, and more than one of a lifting wheel, in operation each of the lifting wheel is arranged in progressively larger diameters to provide varying amounts of counterbalance torque, the counterbalance wheel and each of the lifting wheel are fastened together forming a unitary assembly that rotates around a central axis, a counterbalance assembly is affixed to the mast, the counterbalance assembly comprising at least one of a spring, a counterbalance cable connects the spring to the counterbalance wheel, a lifting cable connects the accessory surface to the lifting wheel;

causing, by way of a user and by way of the release cable, the retractable lock pin assembly to release the lock pin from the lock pin receptacle;

allowing, by way of the user, combination of the accessory surface and the work surface to slide up and down the mast; and releasing the release rail, by way of the user, causing the retractable lock pin assembly to insert the lock pin into the lock pin receptacle abating the accessory surface from moving along the mast, wherein combination of the accessory surface and the work surface height is adjustable by the user in counterbalanced manner.

17. The adjustable height workstation method in accordance with claim 16, further comprising the step of:

moving, by way of the user, the lifting cable between the lifting wheel to change counterbalance of the work surface and the accessory surface.

18. The adjustable height workstation method in accordance with claim 16, further comprising the step of:

configuring a base assembly comprising more than one of a leg, each of the leg comprising a mast connection end and a floor contact end, the base assembly interconnects the mast and each of the leg by way of the mast connection end so that the floor connection end is orientated to provide contact points with floor to stabilize the adjustable height workstation, wherein each of the leg is positioned at an angle with respect to the mast to allow the work surface to descend to the floor without contacting the leg allowing the user to work ergonomically on the work surface at floor level.

19. The adjustable height workstation method in accordance with claim 16, further comprising the step of:

attaching two or more of a roller to the accessory surface, the mast comprising a left edge, a right edge, a front side, and a backside, each of the left edge, right edge, front side, and backside traverse the length of the mast from the top to the bottom, each of the roller are configured to engage either the left edge, the right edge, the front side, or the backside, providing smooth transition when combination of the accessory surface and work surface are repositioned by the user.

20. The adjustable height workstation method in accordance with claim 16, wherein the mast comprising a front side and the backside, the front side facing the user during use of the adjustable height workstation, the lock pin receptacle are disposed in one or more columns along the backside of the mast from proximate the top to proximate the bottom.

* * * * *